US007980261B2

(12) United States Patent
Glatz

(10) Patent No.: US 7,980,261 B2
(45) Date of Patent: Jul. 19, 2011

(54) FREE-ARM CANOPY

(75) Inventor: Adolf Gustav Glatz, Frauenfeld (CH)

(73) Assignee: Glatz AG (CH)

( * ) Notice: Subject to any disclaimer, the term of this patent is extended or adjusted under 35 U.S.C. 154(b) by 0 days.

(21) Appl. No.: 12/450,590

(22) PCT Filed: Jun. 3, 2008

(86) PCT No.: PCT/CH2008/000246

§ 371 (c)(1),
(2), (4) Date: Oct. 1, 2009

(87) PCT Pub. No.: WO2008/148233

PCT Pub. Date: Dec. 11, 2008

(65) Prior Publication Data

US 2010/0095991 A1 Apr. 22, 2010

(30) Foreign Application Priority Data

Jun. 4, 2007 (CH) ..... 0882/07

(51) Int. Cl.
*A45B 17/00* (2006.01)
*A45B 11/00* (2006.01)

(52) U.S. Cl. ..... 135/21; 135/20.1; 135/20.3; 135/912; 135/98

(58) Field of Classification Search ..... 135/90, 135/20.1, 20.3, 21, 912, 98; 211/197; 473/482–484
See application file for complete search history.

(56) References Cited

U.S. PATENT DOCUMENTS

| | | | | |
|---|---|---|---|---|
| 5,156,395 | A * | 10/1992 | Smith | 473/483 |
| 5,718,083 | A * | 2/1998 | Dowdell, II | 49/407 |
| 5,785,069 | A * | 7/1998 | Glatz | 135/20.1 |
| 6,014,980 | A * | 1/2000 | Glatz | 135/20.1 |
| 6,220,261 | B1 | 4/2001 | Glatz | |
| 6,321,763 | B1 * | 11/2001 | Ma | 135/20.1 |
| 6,619,306 | B2 * | 9/2003 | Ma | 135/21 |
| 6,923,194 | B2 * | 8/2005 | Li | 135/21 |
| 6,953,043 | B2 | 10/2005 | Yu | |
| 7,134,442 | B2 * | 11/2006 | Ma | 135/20.1 |
| 7,314,055 | B2 * | 1/2008 | Guo et al. | 135/156 |
| 7,334,590 | B2 * | 2/2008 | Chang | 135/20.3 |
| 7,398,790 | B2 * | 7/2008 | Glatz | 135/20.1 |
| 7,461,665 | B2 * | 12/2008 | Koehn | 135/21 |
| 7,556,051 | B2 * | 7/2009 | Lai | 135/21 |
| 2004/0055628 | A1 | 3/2004 | Yu | |
| 2004/0261827 | A1 * | 12/2004 | Chen | 135/20.1 |
| 2005/0268952 | A1 | 12/2005 | Joen-an Ma | |
| 2006/0243211 | A1 | 11/2006 | Eriksson et al. | |

FOREIGN PATENT DOCUMENTS

| | | |
|---|---|---|
| DE | 299 06 116 U1 | 9/1999 |
| EP | 1 400 186 A1 | 3/2004 |

(Continued)

*Primary Examiner* — Winnie Yip
(74) *Attorney, Agent, or Firm* — George Pappas

(57) ABSTRACT

The invention originates with a mast on the upper end of which a locking and tiltable jib support is arranged. A jib is guided in the jib support such that said jib can be slid and fastened and carries a roof construction on the outer end thereof, wherein said roof construction can be extended like a canopy, fan, or frame. To make the extension and retraction of the jib easier, it is proposed that the jib support be designed with at least four guide and locking rollers, of which at least two engage in a left-handed track and two in a right-handed track of the jib.

20 Claims, 8 Drawing Sheets

FOREIGN PATENT DOCUMENTS

| | | | |
|---|---|---|---|
| EP | 1 654 952 | A1 | 5/2006 |
| WO | WO 9523532 | A1 * | 9/1995 |
| WO | WO 98/08411 | A1 | 3/1998 |
| WO | WO 2005/018369 | A1 | 3/2005 |

* cited by examiner

FREE-ARM CANOPY

This application claims priority of PCT application PCT/CH2008/000246 having a priority date of Jun. 4, 2007, the disclosure of which is incorporated herein by reference.

TECHNICAL FIELD

The invention relates to a cantilever parasol.

BACKGROUND OF THE INVENTION

A cantilever parasol of the type mentioned at the outset is known from WO 98/08411 A1. Displacement—that is to say, extension and retraction—of an arm on an arm mounting which is arranged at the upper end of the mast presents problems, because as the length of extension of the arm on the arm mounting increases, the arm tilts and clamps, with the result that the arm can in practice only be further displaced by lifting it. These problems are reinforced by the parasol being attached to the arm by means of a ball-and-socket joint, which allows the parasol to be further adjusted and adapted. However, this increases the risk that the arm will tilt sideways during displacement. Similar problems also arise, moreover, when a telescopic mast of a cantilever parasol of this kind is adjusted in height.

Various constructions of cantilever parasols are known, allowing adjustment as the sun moves across the sky. WO 2005/018369 A1 discloses a cantilever parasol in which the arm is connected to the mast by means of a height-adjustable slide. A supporting strut connects the upper mast end to the central region of the arm. The disadvantage here is that the supporting strut determines a guidance curve, so there are limitations to the way the arm can be adjusted in the horizontal direction, independently of a guide support. This type of construction is not height-adjustable, is weighty and is bulky to ship.

Tests have shown that guiding the arm by means of rollers does not in itself solve the problem. If the rollers are arranged below and above the arm, the extension movement begins to stick as the length of extension increases. To enable complete extension to be performed smoothly, with this type of construction too it is necessary to lift the parasol part somewhat and to extend the arm forward of the parasol part or retract it again. Additional problems arise if the arm is in the form of an arc, since this construction is prone to sideways tilting and clamping. This is exacerbated by the fact that the arm is typically difficult to access from the parasol side, because of furniture that is set up in the shade of the parasol.

SUMMARY OF THE INVENTION

The object of the invention is to make the steps of adjusting a cantilever parasol of the type mentioned at the outset smooth-running.

The object of the invention is achieved by a cantilever parasol. Here, the measures of the invention have the effect that the arm of the parasol—once locking has been released—can be moved over its entire length smoothly and without sideways tilting, that is to say that the arm can be extended and retracted without additional supports. These measures are particularly suitable for a parasol according to WO 98/08411 A. In this case, the arm need not be rectilinear, but rather the advantages are also obtained in particular if the arm and its guide tracks are in the form of an arc. This arc need not be in the shape of a circle segment but may also correspond to a segment of another shape of conical section (ellipse segment, hyperbola segment or parabola segment) or a synthesized form of parts placed together and having a varying radius of curvature.

A particularly advantageous embodiment, with rollers as the guide members, since in that case the rollers—when they are put under load transversely with respect to the axis of the roller—prevent the end faces of the rollers from abutting in braking manner against the base faces of the groove-like guide track with the possibility of damage thereto, since they are at an appropriate distance from the base face.

If the shapes of the guide member and the guide track are matched appropriately, the guide member may take the form of a brake block.

It is advantageous if the construction of the cantilever parasol is such that the center axis of the guide tracks coincides approximately with the center axis of the mast and/or the arm, but in any case deviates from the center axis thereof by no more than 15%, preferably no more than 10%, of the thickness of the corresponding profile of the mast and/or the arm.

The inventive solution is particularly advantageous with the construction of the cantilever parasol in accordance with which the arm mounting is constructed to have at least four rollers, of which respectively two engage in a left-hand guide track of the arm and two in a right-hand one. It is advantageous for stability and load distribution if the spacing between the axes of the front and rear rollers is 7 to 15%, preferably approximately 10%, of the length of extension of the arm.

To take up relatively large loads, it may be advantageous to use double rollers having a rocker-type horizontal tie bar.

The arm may be in rectilinear form or indeed be arcuate.

It is an advantageous construction for the arm mounting to be arranged such that it can tilt on the mast and to have at least one locking device for fixing and releasing the extension position of the arm and its tilt position, individually or in combination.

It is advantageous to use at least one wedge which is constructed and arranged such that, simultaneously, it provides a safety latching to the mast head by way of a toothed element, on the one hand, and a force-fitting connection between the mast head and the arm by way of wedge surfaces, on the other. Preferably, the locking device has two opposed wedges which may be clamped to one another. The toothed element of the wedge may have notches or grooves which, during the locking procedure, engage in corresponding grooves or notches on the mast head and provide a form-fitting locking. For fixing the arm force-fittingly, the wedge has surfaces which cooperate with wedge surfaces of a brake block, the latter abutting with frictional fit against the arm.

The elements which have been mentioned above, which are claimed and which are described in the exemplary embodiments below and are to be used in accordance with the invention are not subject to any particular exceptional conditions as regards their size, shape, material used or technical design, with the result that the selection criteria that are known in the respective field of application can be used without restriction.

BRIEF DESCRIPTION OF THE DRAWINGS

Further details, advantages and features of the subject matter of the present invention will become apparent from the description which follows of the accompanying drawings, in which—by way of example—cantilever parasols according to the invention are explained. In the drawings.

DETAILED DESCRIPTION OF THE PREFERRED EMBODIMENT

Figure 1:
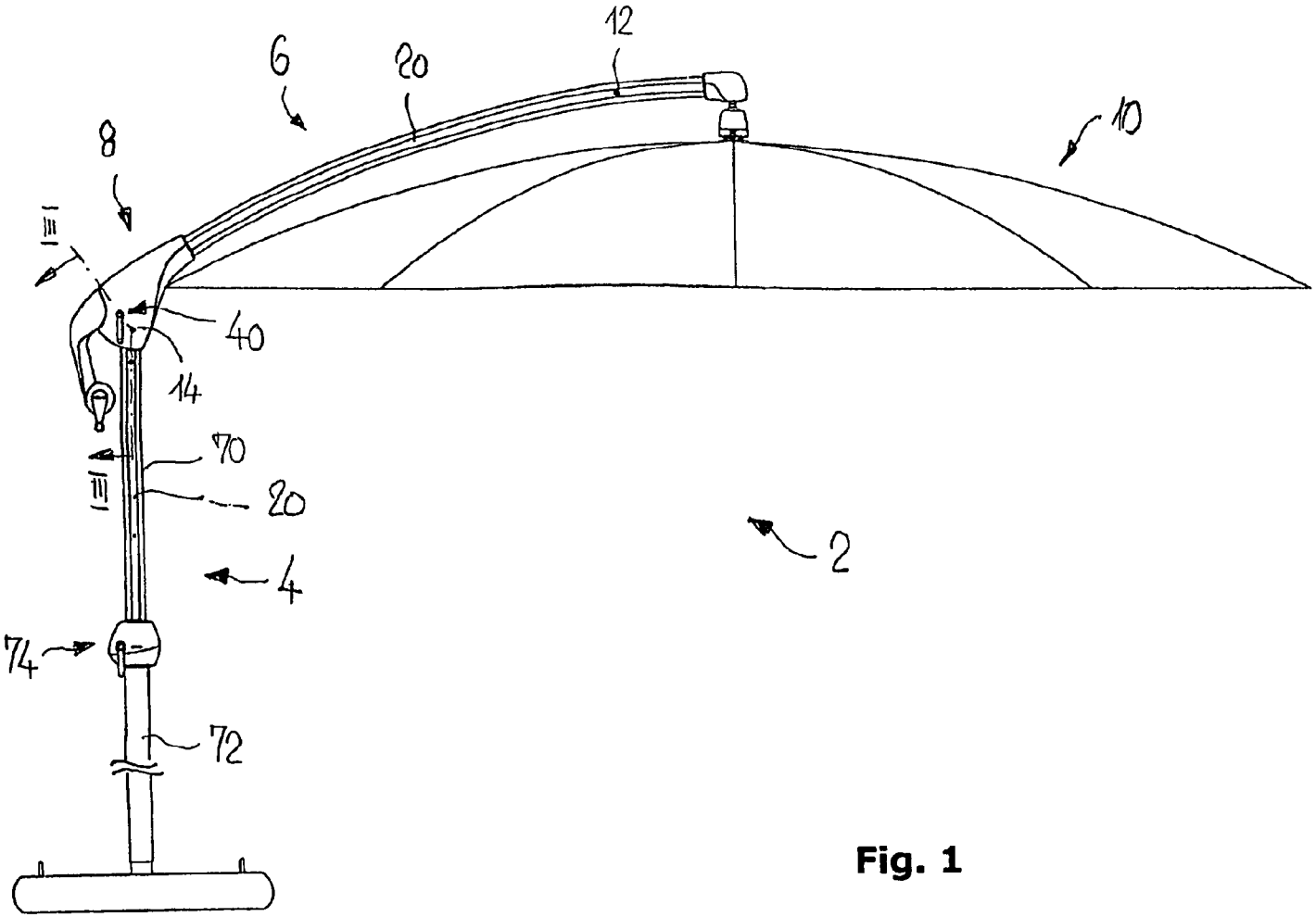
FIG. 1 shows an illustration of a cantilever parasol according to a preferred exemplary embodiment of the invention, in the opened condition, in side view
Figure 2:
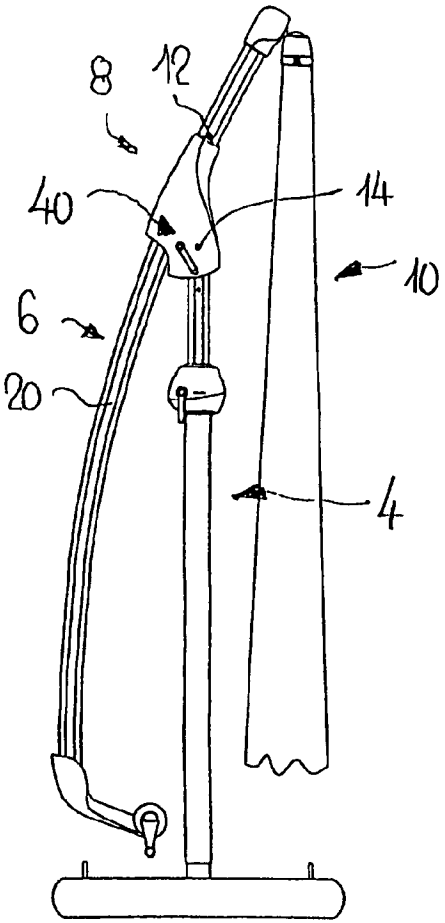
FIG. 2 shows an illustration of the cantilever parasol according to FIG. 1, in the folded condition.
Figure 4:
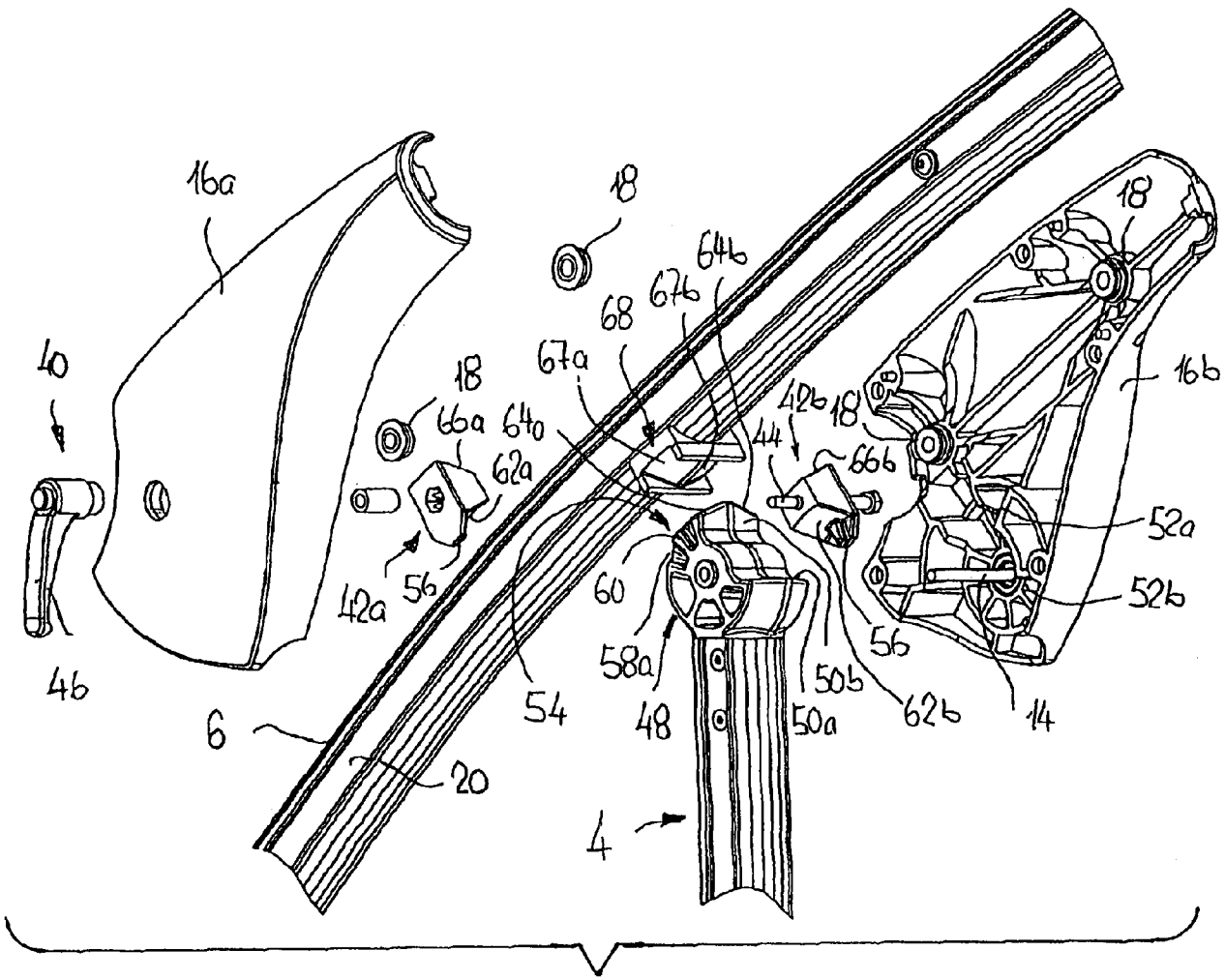
FIG. 4 shows an exploded view of the arm mounting according to FIG. 3.

In FIG. 1, a cantilever parasol according to a preferred exemplary embodiment of the invention is shown from the side, opened, and designated 2 as a whole. The cantilever parasol substantially comprises a mast 4 and an arm 6 which is arranged such that it is retractable into the mast 4 and extendable therefrom—that is to say such that it is displaceable in the arm mounting 8 in its longitudinal direction—and a canopy structure 10 of conventional construction. The canopy structure is in this case opened in the manner of an umbrella, fan or tenter frame or in similar manner. In FIG. 1, the mast upper part 70 is in the extended position. FIG. 2 shows the parasol from FIG. 1 with the canopy structure 10 closed and the arm 6 retracted into the arm mounting 8 until an abutment 12 of the arm abuts against the arm mounting 8. The arm mounting 8 is moreover tilted into the closed position about the tilt axis 14 in such a way that the arm 6 is pivoted against the mast 4. In FIG. 2, the mast upper part is in the lowered position.

Figure 3:
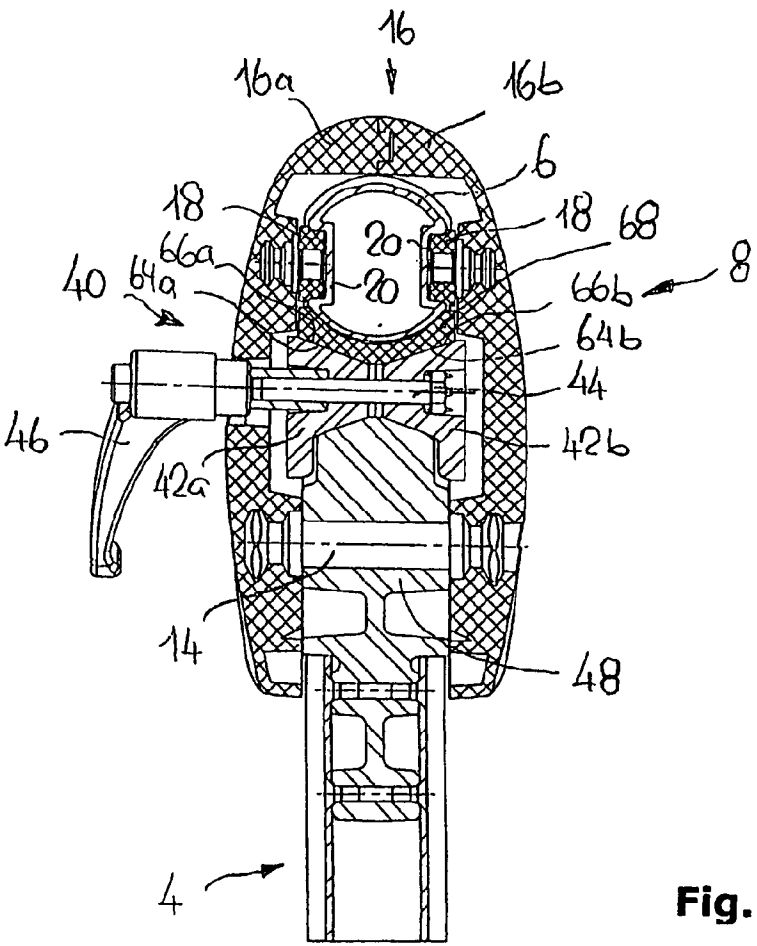
FIG. 3 shows the arm mounting of the cantilever parasol according to FIG. 1, in the section from FIG. 1 and on a larger scale.

The arm mounting 8 has a housing 16 comprising two housing halves 16*a*, 16*b* in which two rollers 18 are respectively arranged, which engage in a left-hand and a right-hand guide track 20 of the arm 6 (FIG. 3). The guide tracks 20 take the form of a groove and have base faces 22 and side faces 24 with which the rolling surfaces 26 of the rollers 18 cooperate. The arm 6 and the guide tracks 20 may be in rectilinear form or, as in the present example, curved.

The center axis 28 of the guide tracks 20 should not deviate from the center axis 30 of the arm 6 by more than 15%, preferably not more than 10%, of the thickness of the arm 6. The lateral arrangement of the rollers 18 at the level of the center axis 30 of the arm 6 gives the desired smoothness of running. Depending on the length of the extension, considerable pressure on the rollers 18 is generated. To avoid overloading the rollers 18 and rolling surfaces, sufficient spacing between the rollers is established in the direction of rolling. A spacing between the rollers of 7 to 15%, preferably approximately 10%, of the length of extension of the arm 6 has proved suitable.

Figure 6A:
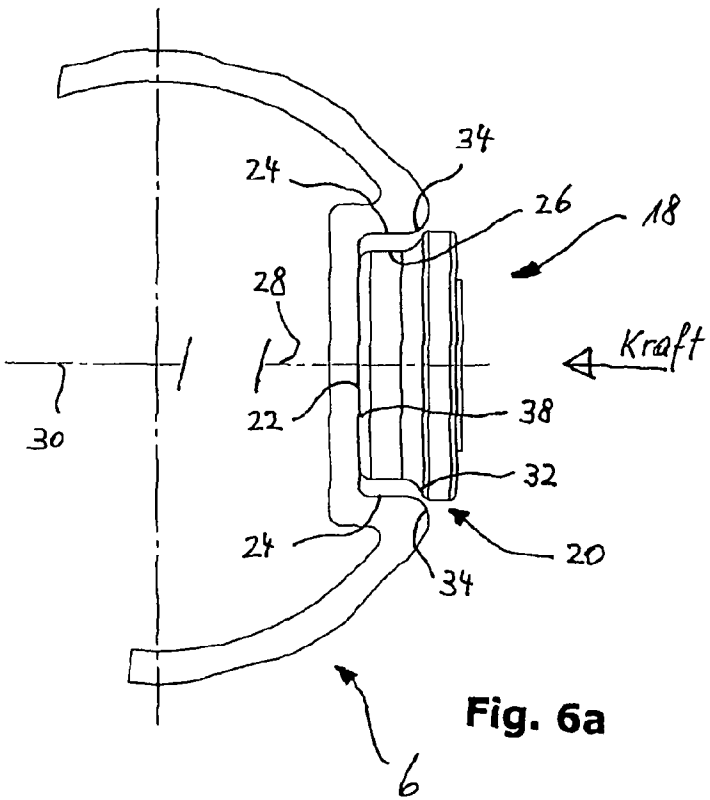
FIG. 6*a* shows an illustration of the rollers in the braking position, by way of the example of the preferred embodiment of the arm profile or mast profile.
Figure 5A:
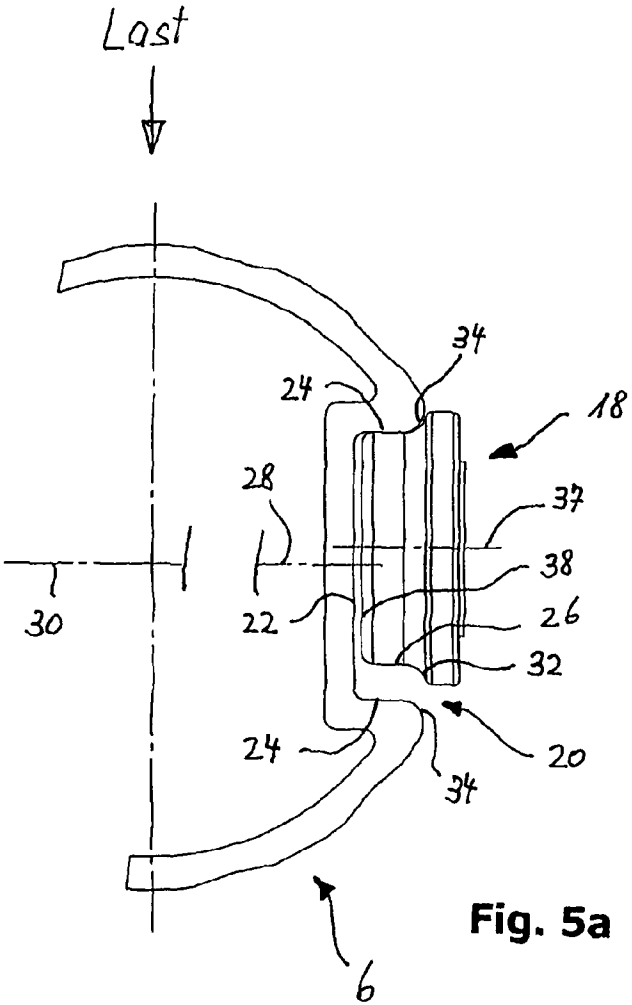
FIG. 5*a* shows an illustration of the rollers in the rolling position, by way of the example of a preferred embodiment of the arm profile or mast profile.

In the preferred exemplary embodiment, the rollers 18 have—as illustrated in FIGS. 5*a* and 6*a*—lateral guide contours 32 which in each case delimit the rolling surfaces 26 of the rollers 18. By means of the guide contours 32, the rollers 18 cooperate with edge contours 34 on the guide tracks 20. The dimensions of the rollers 18 and the guide tracks 20 are made such that, depending on the direction of force, the rollers 18 can either only act as rolling and guide rollers, as shown in FIG. 5*a*, or can also act as braking and locking means, as illustrated in FIG. 6*a*. The rollers 18 operate purely as rolling and guide rollers as in FIG. 5*a* when they are put under load predominantly in a direction transverse with respect to their axis 37. In that case, the guide contours 32 which cooperate with the edge contours 34 of the guide tracks 20 prevent the rollers 18 from penetrating further into the groove-like guide tracks 20. This also prevents end faces 38 of the rollers 18 from being able to come into contact with the base faces 22 of the guide tracks 20, exert a braking action and damage them. If, however, the rollers 18 are put under load in their axial direction, the rollers 18 migrate along their guide contours 32, beyond the edge contours 34 of the guide tracks 20, and are thus lifted away from the side faces 24 of the guide tracks 20 by means of their rolling surfaces 26, and can be pressed further against the base faces 22 of the guide tracks by means of their end faces 38 and hence bring about a braking or blocking frictional fit, as is clear from FIG. 6*a*.

Figure 6B:
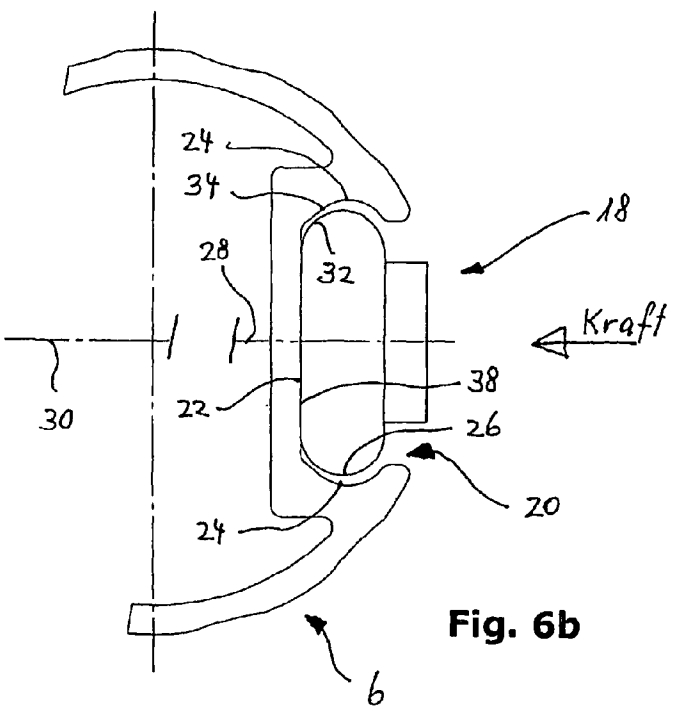
FIG. 6*b* shows an illustration of the rollers in the braking position, by way of the example of the alternative embodiment.
Figure 5B:
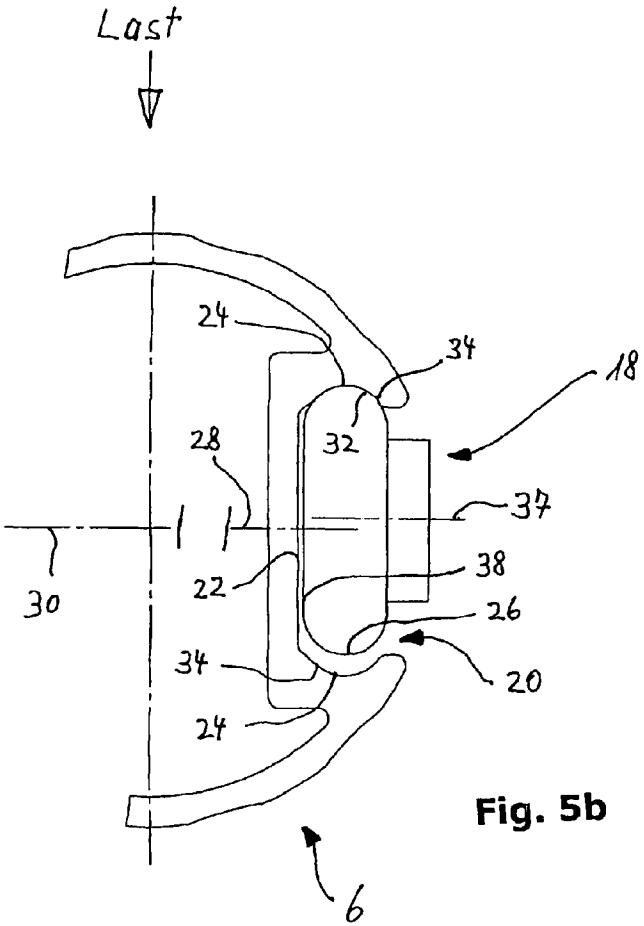
FIG. 5*b* shows an illustration of the rollers in the rolling position, by way of the example of an alternative embodiment.

An alternative, but in principle equally valid, embodiment of the rollers and the guide contours is illustrated in FIGS. 5*b* and 6*b*.

The arm mounting 8 has a locking device 40 which has a double function, that is on the one hand to fix and release the tilt position of the arm mounting 8 about the tilt axis 14 in relation to the mast 4, and on the other hand to secure the extended position of the arm 6. For this purpose, the arm mounting 8 includes two wedges 42*a*, 42*b* which are constructed as mirror images of one another, and may be clamped and released in relation to one another by means of a threaded pin 44 and a screw-on handle 46. The wedges 42*a*, 42*b* are arranged in the housing 16, which is arranged on a mast head 48, with the wedges 42, 42*a* cooperating as indicated below to lock the tilt position between the mast head 48 and the housing 16 and to secure the position of the arm 6 between the mast head 48 and the arm 6.

In order to limit in general the angle of tilt of the arm mounting 8, the mast head 48 includes abutments 50*a*, 50*b* which delimit the path of pivoting of corresponding abutments 52*a*, 52*b* in the housing 16 of the arm mounting 8. For fixing the tilt position when the arm is extended (FIG. 1) and when the arm is retracted (FIG. 2), there is provided a toothed element 54 in which, in the clamped condition, for each wedge 42*a*, 42*b*, a notch 56 in the wedge 42*a*, 42*b* engages in a groove 58*a* or 58*b* in the mast head 48. To enable the tilt positions to be altered, the handle 46 must be screwed open far enough for the notches 56 to be able to be released from the grooves 58*a* or 58*b* and to move beyond the intermediate web 60 on the mast head 48, so that they can engage in the adjacent groove for the other tilt position. Screwing the handle closed re-establishes fixing.

For fixing the extended position of the arm 6, the wedges 42*a*, 42*b* each include wedge surfaces 62*a*, 62*b* which cooperate on the one hand with wedge surfaces 64*a*, 64*b* on the mast head 48, and on the other hand further wedge surfaces 66*a*, 66*b* which cooperate with wedge surfaces 76*a*, 76*b* on a brake block 68 which abuts against the arm 6. When the handle 46 is screwed closed, the brake block 68 is pressed against the arm 6 and holds it fixed in the selected position by force fit—that is to say frictional fit. Screwing it open releases the frictional fit and allows the arm 6 to be displaced. Because the frictional fit requires a smaller release of the handle 46 than releasing the toothed element 54 for the tilt position, releasing the locking of the arm 6 does not automatically mean that the tilt position is released.

In the present exemplary embodiment, the mast 4 is made in two parts, with a mast upper part 70 being arranged telescopically inside a mast lower part 72 and being fixable in desired height positions by means of a fixing device 74. Here, the mast upper part 70 has on two sides guide tracks 20 in which rollers 18 engage. The profile of the mast upper part 70 is identical to that of the arm 6.

The rollers 18 are arranged in a housing 80 which is formed from two housing parts 80*a*, 80*b* connected to the mast lower part 72. The fixing device 74 is formed by a roller 18 which is mounted on a threaded pin 81 having a thread 84 and a press-fit flange 86. By means of a handle 82 which is connected to the threaded pin, the roller 18 may be pressed force-fittingly by means of the press-fit flange 86 into the guide track 20 in the axial direction, as illustrated in FIG. 6*a* or FIG. 6*b*, such that the end face 38 of the roller 18 acts on the base face 22 of the guide track 20 in braking or blocking manner.

Figure 9:
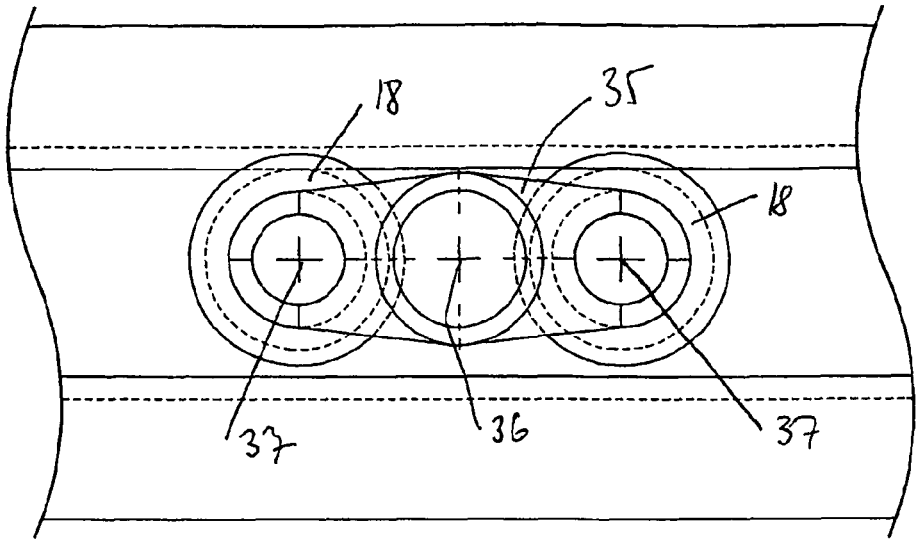
FIG. 9 shows the illustration of an alternative to the embodiment of the invention having two rollers which are inserted, by way of a horizontal tie bar to distribute the loads, in the direction of viewing the roller axis and the support pin.
Figure 10:
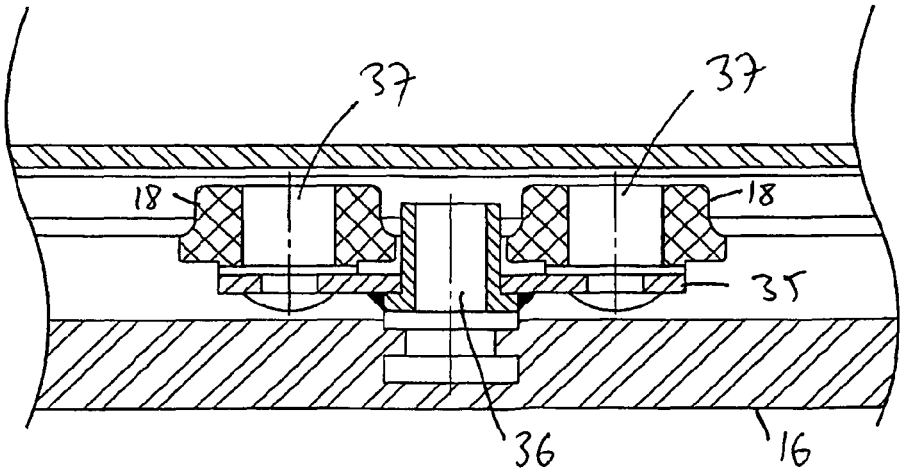
FIG. 10 shows the illustration in cross-section transversely with respect to the roller axes according to FIG. 9.

FIGS. 9 and 10 illustrate an alternative embodiment of the guide members in which the latter do not take the form of individual rollers but pairs 18 of rollers whereof the axes 37 are connected to a horizontal tie bar 35. The horizontal tie bar 35 is inserted into the housing with a support pin 36. This embodiment—which is somewhat more complicated—has the advantage that the loads can be distributed better.

Figure 7:
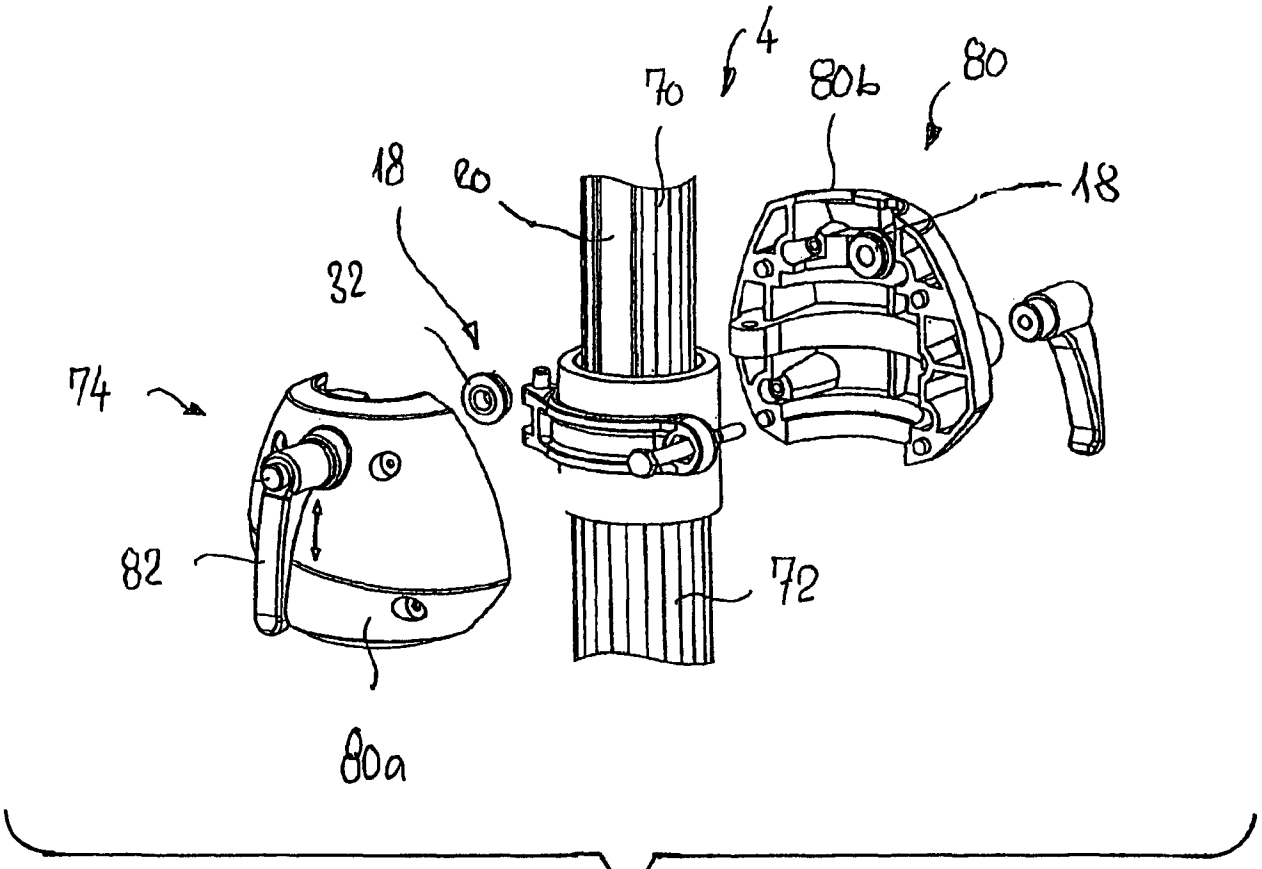
FIG. 7 shows an illustration of an embodiment—which is inventive but not claimed—in exploded view, of the connection region of a mast upper part which can be telescoped with a mast lower part, according to FIG. 1.
Figure 8:
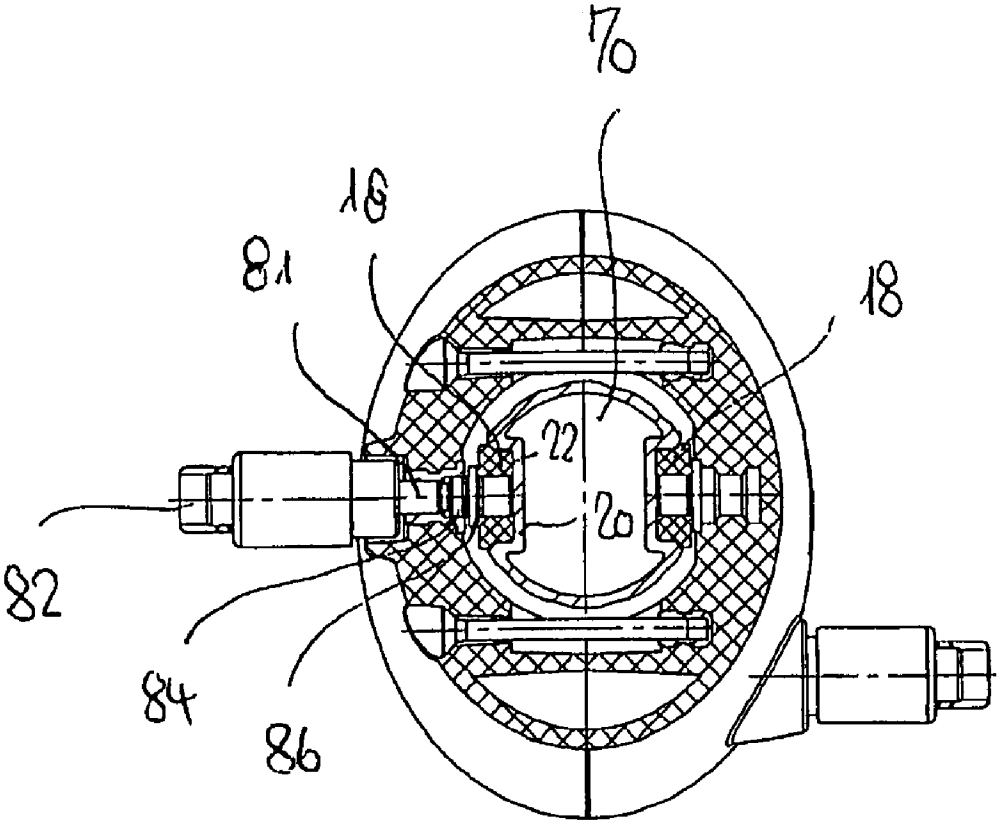
FIG. 8 shows a horizontal section through the height locking in FIG. 7.

If the invention is to be used on the mast of a cantilever parasol, the mast 4 will be made in at least two parts, with a mast upper part 70 and a mast lower part 72, and will be fixable in different height positions, with the mast upper part 70 having the guide tracks, and the guide members—preferably the rollers 18—being connected to the mast lower part 72. The mast profile of the mast upper part 70 may be identical to that of the arm 6—as described above. Optionally, it is provided for at least one of the rollers 18 to be constructed with its end face 38 as the clamping face for a force-fitting height locking, and at least one of the axes of the rollers 18 to be constructed as a clamping screw 81 with a press-fit flange 86. For this, the reader is referred in particular to FIGS. 7 and 8.

| List of reference numerals | |
|---|---|
| 2 | Cantilever parasol |
| 4 | Mast |
| 6 | Arm |
| 8 | Arm mounting |
| 10 | Canopy structure |
| 12 | Abutment |
| 14 | Tilt axis |

-continued

| List of reference numerals | |
|---|---|
| 16 | Housing |
| 16a | Housing halves |
| 16b | Housing halves |
| 18 | Roller |
| 20 | Guide track |
| 22 | Base face |
| 24 | Side faces |
| 26 | Rolling surface |
| 28 | Center axis of 20 |
| 30 | Center axis of 6 |
| 32 | Guide contour of rollers |
| 34 | Edge contours of guide tracks |
| 35 | Horizontal tie bar |
| 36 | Support pin |
| 37 | Axis of 18 |
| 38 | End face of rollers |
| 40 | Locking device |
| 42a | Wedges |
| 42b | Wedges |
| 44 | Threaded pin |
| 46 | Handle for 40 |
| 48 | Mast head |
| 50a | Abutment of 48 |
| 50b | Abutment of 48 |
| 52a | Abutment of 16 |
| 52b | Abutment of 16 |
| 54 | Toothed element |
| 56 | Notch |
| 58a, b | Groove |
| 60 | Intermediate web |
| 62a | Wedge surface of 42a |
| 62b | Wedge surface of 42b |
| 64a | Wedge surface of 48 |
| 64b | Wedge surface of 48 |
| 66a | Wedge surface of 42a |
| 66b | Wedge surface of 42a |
| 67a | Wedge surface of 68 |
| 67b | Wedge surface of 68 |
| 68 | Brake block |
| 68 | Mast upper part |
| 72 | Mast lower part |
| 74 | Fixing device |
| 80 | Housing |
| 80a | Housing part |
| 80b | Housing part |
| 81 | Threaded pin |
| 82 | Handle for 74 |
| 84 | Thread |
| 86 | Press-fit flange |

The invention claimed is:

1. A cantilever parasol having a mast, an arm mounting arranged at the upper end of the mast, an arm being guided displaceably and fixably in the arm mounting, the arm carrying at its outer end an openable canopy structure, characterized in that the arm has, on mutually remote sides, longitudinally extending groove guide tracks which are engaged by guide members carried by the arm mounting, and wherein the guide members have lateral guide contours which cooperate with edge contours extending longitudinally along the groove guide tracks.

2. The cantilever parasol as claimed in claim 1, characterized in that the guide members are rollers.

3. The cantilever parasol as claimed in claim 2, characterized in that a diameter of the roller and the contour thereof are matched to the longitudinally extending groove guide track and edge contours thereof such that, when the roller is put under load transversely with respect to its axis, an end face of the roller is held at a distance from a base face of the guide track.

4. The cantilever parasol as claimed in claim 3, characterized in that the arm mounting is constructed to have at least four rollers, wherein two of the rollers engage the guide track on one of said remote sides of the arm and two of the rollers engage the guide track on the other of said remote sides of the arm.

5. The cantilever parasol as claimed in claim 3 characterized in that the arm mounting is tiltable and has at least one locking device for fixing and releasing the extension position of the arm and its tilt position, individually or in combination.

6. The cantilever parasol as claimed in claim 2, characterized in that the arm mounting is constructed to have at least four rollers, wherein two of the rollers engage the guide track on one of said remote sides of the arm and two of the rollers engage the guide track on the other of said remote sides of the arm.

7. The cantilever parasol as claimed in claim 2 characterized in that the arm mounting is tiltable and has at least one locking device for fixing and releasing the extension position of the arm and its tilt position, individually or in combination.

8. The cantilever parasol as claimed in claim 1, characterized in that a center axis of the guide track deviates from a center axis of the arm by no more than 15% of an overall thickness of a profile of the mast or the arm.

9. The cantilever parasol as claimed in claim 8, characterized in that the arm mounting is constructed to have at least four guide members and wherein such guide members are rollers, wherein two of the rollers engage the guide track on one of said remote sides of the arm and two of the rollers engage the guide track on the other of said remote sides of the arm.

10. The cantilever parasol as claimed in claim 8 characterized in that the arm mounting is tiltable and has at least one locking device for fixing and releasing the extension position of the arm and its tilt position, individually or in combination.

11. The cantilever parasol as claimed in claim 1, characterized in that the arm mounting is constructed to have at least four of the guide members and wherein such guide members are rollers, wherein two of the rollers engage the guide track on one of said remote sides of the arm and two of the rollers engage the guide track on the other of said remote sides of the arm.

12. The cantilever parasol as claimed in claim 11, characterized in that a spacing between axes of the rollers on each of said remote sides of the arm is 7 to 15%, of the length of extension of the arm.

13. The cantilever parasol as claimed in claim 11 characterized in that the arm mounting is tiltable and has at least one locking device for fixing and releasing the extension position of the arm and its tilt position, individually or in combination.

14. The cantilever parasol as claimed in claim 1, characterized in that the guide members take the form of a roller arrangement each having at least two rollers, wherein the two rollers are connected by means of a connection element taking a form of a horizontal tie bar, wherein the horizontal tie bar has a support pin connected to a housing.

15. The cantilever parasol as claimed in claim 1, characterized in that the arm is arcuate in form.

16. The cantilever parasol as claimed in claim 1, characterized in that the arm mounting is tiltable and has at least one locking device for fixing and releasing the extension position of the arm and its tilt position, individually or in combination.

17. The cantilever parasol as claimed in claim 1, characterized in that the mast has a mast head on which there is arranged the arm mounting, which has at least one locking device including at least one wedge which is constructed and arranged such that, simultaneously, it provides a safety latching to the mast head by way of a toothed element, on the one hand, and a force-fitting connection between the mast head and the arm by way of wedge surfaces, on the other.

18. The cantilever parasol as claimed in claim 17, characterized in that the locking device has two wedges which are clamped to one another.

19. The cantilever parasol as claimed in claim 17, characterized in that the toothed element of the wedge has notches or grooves which, during the locking procedure, engage in corresponding grooves or notches on the mast head and provide a form-fitting locking.

20. The cantilever parasol as claimed in claim 17, characterized in that the wedge surfaces of the wedge cooperate with wedge surfaces on a brake block which in the fixed condition abuts with frictional fit against the arm.

* * * * *

UNITED STATES PATENT AND TRADEMARK OFFICE

CERTIFICATE OF CORRECTION

PATENT NO. : 7,980,261 B2
APPLICATION NO. : 12/450590
DATED : July 19, 2011
INVENTOR(S) : Gustav Adolf Glatz It is certified that error appears in the above-identified patent and that said Letters Patent is hereby corrected as shown below:

Column 3, line 7, after "section" insert --III-III--.

Signed and Sealed this
Eighteenth Day of October, 2011

David J. Kappos

David J. Kappos
*Director of the United States Patent and Trademark Office*